US006042125A

United States Patent [19]

Wu

[11] Patent Number: 6,042,125

[45] Date of Patent: Mar. 28, 2000

[54] INLINE SKATE WITH DETACHABLE ROLLER DEVICE

[76] Inventor: Elbert Hsin En Wu, 2434 W. Main St., Alhambra, Calif. 91801

[21] Appl. No.: 09/021,118

[22] Filed: Feb. 10, 1998

[51] Int. Cl.[7] ..... A63C 1/00

[52] U.S. Cl. ..... 280/11.27; 280/11.22; 280/11.26; 280/11.3

[58] Field of Search ..... 280/11.22, 11.27, 280/11.3, 841, 11.19, 11.26, 7.13, 825, 9

[56] References Cited

U.S. PATENT DOCUMENTS

| | | | |
|---|---|---|---|
| 4,008,901 | 2/1977 | Conn | 280/7.13 |
| 4,492,385 | 1/1985 | Olson | 280/7.13 |
| 4,932,675 | 6/1990 | Olson et al. | 280/7.13 |
| 5,803,469 | 9/1998 | Yoham | 280/11.27 |
| 5,820,138 | 10/1998 | Hajat Dost Sani | 280/7.13 |
| 5,887,898 | 3/1999 | Petrosino | 280/825 |

*Primary Examiner*—J. J. Swann
*Assistant Examiner*—James S. McClellan
*Attorney, Agent, or Firm*—Raymond Y. Chan; David and Raymond

[57] ABSTRACT

A walkable inline skate includes a footwear, a roller sole integrally connected with a bottom portion of the footwear, a receiving groove centrally extended along of the roller sole, a set of roller device detachably connected with the roller sole, a locking means for ensuring the roller device is affixed within the receiving groove, a pair of supporters integrally extended from a bottom surface of the roller sole for walking purpose that defines a receiving chamber for receiving and storing the roller device when it is detached from the roller sole while walking, and a brake device connected to a rear end of the footwear. The walkable inline skate allows the user to skate or walk selectively with the same footwear according to the road surface condition to travel from places to places.

16 Claims, 6 Drawing Sheets

INLINE SKATE WITH DETACHABLE ROLLER DEVICE

FIELD OF THE INVENTION

The present invention relates to inline skates, and more particularly to a walkable inline skate which allows the user to skate and walk selectively with the same footwear in accordance with the road surface condition while traveling from places to places.

BACKGROUND OF THE INVENTION

Skating has been a popular exercise and sporting for a long period of time. It is also considered as a kind of transportation to get from places to places. The conventional skate has four wheels, including a pair of parallel front wheels and a pair of parallel rear wheels, arranged under a footwear. Certainly, to travel on such conventional skate is faster than walking or jogging and may have more enjoyment.

Recently, a kind of improved inline skate, also known as the inline skates, becomes more and more popular that contains four wheels arranged in a straight line manner. The advantages of the inline skate over the conventional skate are that the inline skate enables the user to turn the corner more easily, plus the traveling speed of the inline skate is also improved over the conventional skate.

Both of the above described skates are perfectly suitable for use in the skating ranch or when the skating road conditions are smooth. However, when the road conditions are not ideal, the traditional skates or the inline skates might not be able to perform the task of providing transportation for the user to get from places to places. Such conditions includes that:

(1) the road has a relatively steep slope where the user needs to climb up or even go down, wherein the uphill climbing might be too difficult and the downhill speed might be too fast to travel that might endanger the skater.

(2) the user needs to travel between the skating ranch and the vehicle.

(3) the road condition is rough such as on a black top or constructing road.

(4) the skater needs to climb or descend a series of staircase to get across the street through the overhead bridge or subway.

Although the conventional skates or inline skates can provide faster speed than walking or jogging, but as described above, there are many situations that the skater needs to walk or travel without the skate for just a short period of time during his or her journey. Some skaters resolve such dilemma by still trying to skate on the bad road condition. However, in the case of steep slope or climbing and descending on the staircase, the skater may receive series injury if accident occurs.

SUMMARY OF THE INVENTION

The main objective of the present invention is to provide a walkable inline skate with detachable roller device, which allows the user to skate and walk selectively with the same footwear in accordance with the road surface condition.

Another objective of the present invention is to provide a walkable inline skate with detachable roller device, which can easily be switched from a walking mode to a inline skating mode, and vice versa without using any special tool.

Yet another objective of the present invention is to provide a walkable inline skate with detachable roller device, which comprises a detachable roller device and contains a receiving chamber to store a set of roller device which is detached from the walkable inline skate during the walking mode.

Still another objective of the present invention is to provide a walkable inline skate which provides a strong and durable connection between a roller sole of the footwear and the set of roller device.

Accordingly, a walkable inline skate comprises a footwear, a roller sole, a pair of supporters, a roller device, a locking means, and a braking arrangement.

The roller sole is integrally connected with a bottom portion of the footwear. The pair of supporters are integrally affixed to two sides of a bottom surface of the roller sole respectively to form a walkable sole and define a receiving chamber therebetween, wherein the receiving chamber is longitudinally extended along the bottom surface of the roller sole.

A receiving groove is centrally and longitudinally extended along the bottom surface of the roller sole, wherein the receiving groove has a receiving front end positioned at a front end of the roller sole and a rear stopper positioned at a rear end of the roller sole.

The roller device comprises a holding blade member and four roller wheels rotatably mounted along the holding blade member in a straight line manner, wherein the holding blade member has a top connecting rail longitudinally extended along the holding blade member for fittedly engaging with the receiving groove by sliding the top connecting rail into the receiving groove through the receiving front end thereof. The locking means is provided between the roller sole and the holding blade member for firmly locking the top connecting rail of the roller device to affix within the receiving groove. The brake device is connected to a rear end of the footwear.

Whereby, the roller device can be detached from the receiving groove while the locking means is released and be received within the receiving chamber formed between the two supporters.

DETAILED DESCRIPTION OF THE PREFERRED EMBODIMENTS

Figure 1:
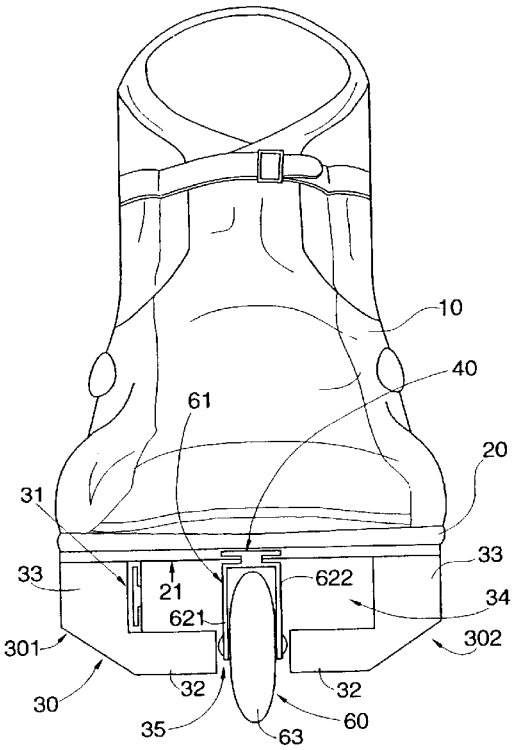
FIG. 1 is a front view of a inline skate with detachable roller device according to a first preferred embodiment of the present invention, where the walkable inline skate is in a inline skating mode.
Figure 2:
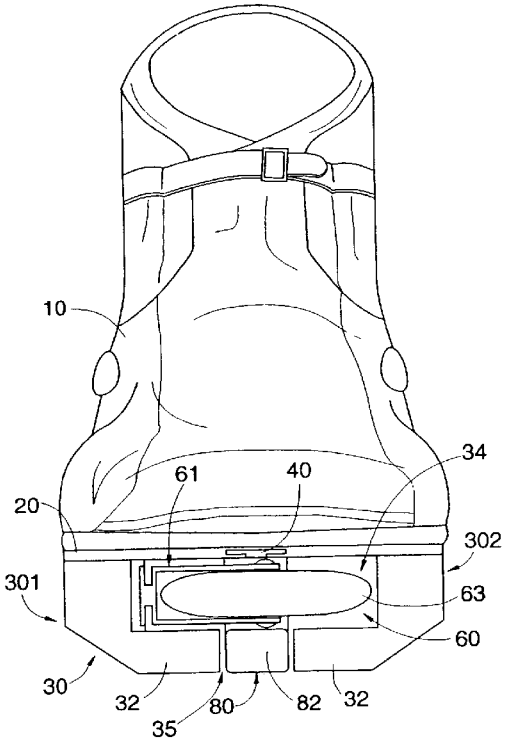
FIG. 2 is a front view of the inline skate with detachable roller device according to the above first preferred embodiment of the present invention, where the walkable inline skate is in a walking mode.
Figure 3:
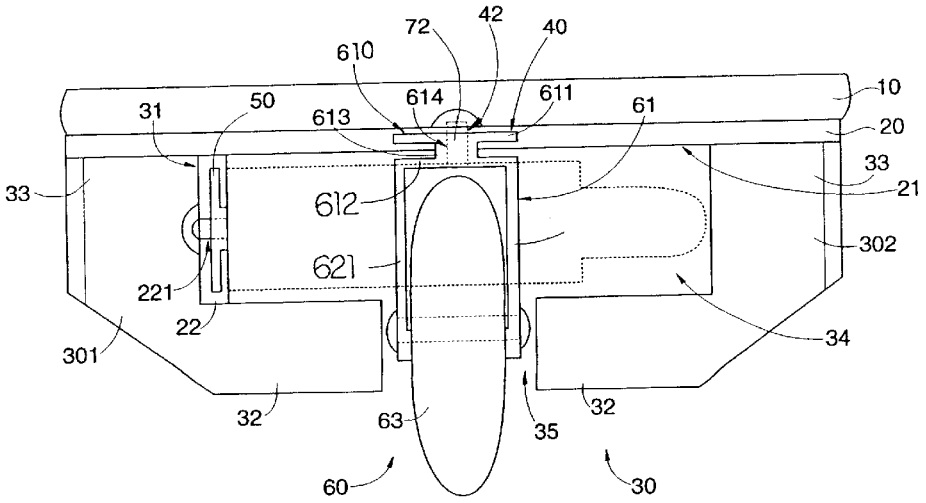
FIG. 3 is a partial sectional view of the inline skate with detachable roller device according to the above first preferred embodiment of the present invention.

Referring to FIGS. 1 to 3 of the drawings, a walkable inline skate according to a first preferred embodiment of the present invention is illustrated. The walkable inline skate comprises a footwear 10, a roller sole 20 integrally connected with a bottom portion of the footwear 10, a pair of L-shaped supporters 301, 302 integrally affixed to two sides of a bottom surface 21 of the roller sole 20, a receiving groove 40 centrally provided and extended along the length of the roller sole 20, a side receiving groove 50 positioned and extended along the length of a rigid side wall 22 which is downwardly and perpendicularly from the bottom surface 21 of the roller sole 20 and is attached to an inner wall 31 of one of the supporters 301, a set of roller device 60 being affixed to the roller sole 20 by engaging with the receiving groove 40, wherein the roller device 60 can also be detached from the receiving groove 50 during a walking mode, a locking means 70 for ensuring the roller device 60 be affixed within the receiving groove 40 during a inline skating mode, and a brake device 80 connected to a rear end of the footwear 10.

The pair of L-shaped supporters 301, 302, which are preferably made of rubber material or the like, are integrally affixed to two sides of the bottom surface 21 of the roller sole 20 respectively to form a walkable sole 30 for walking. According to the first preferred embodiment, each of the two L-shaped supporters 301, 302 has a flat base 32 for walking purpose and a vertical support 33. The two L-shaped supporters 301, 302 further define a receiving chamber 34 between the two vertical supports 33 and a passing gap 35 between the two flat bases 32, wherein the receiving chamber 34 is longitudinally extended along the bottom surface 21 of the roller sole 20 and has a size larger than the roller device 60, so that during the walking mode, the roller device 60 detached from the roller sole 20 is able to be transversely stored in the receiving chamber 34.

Figure 4:
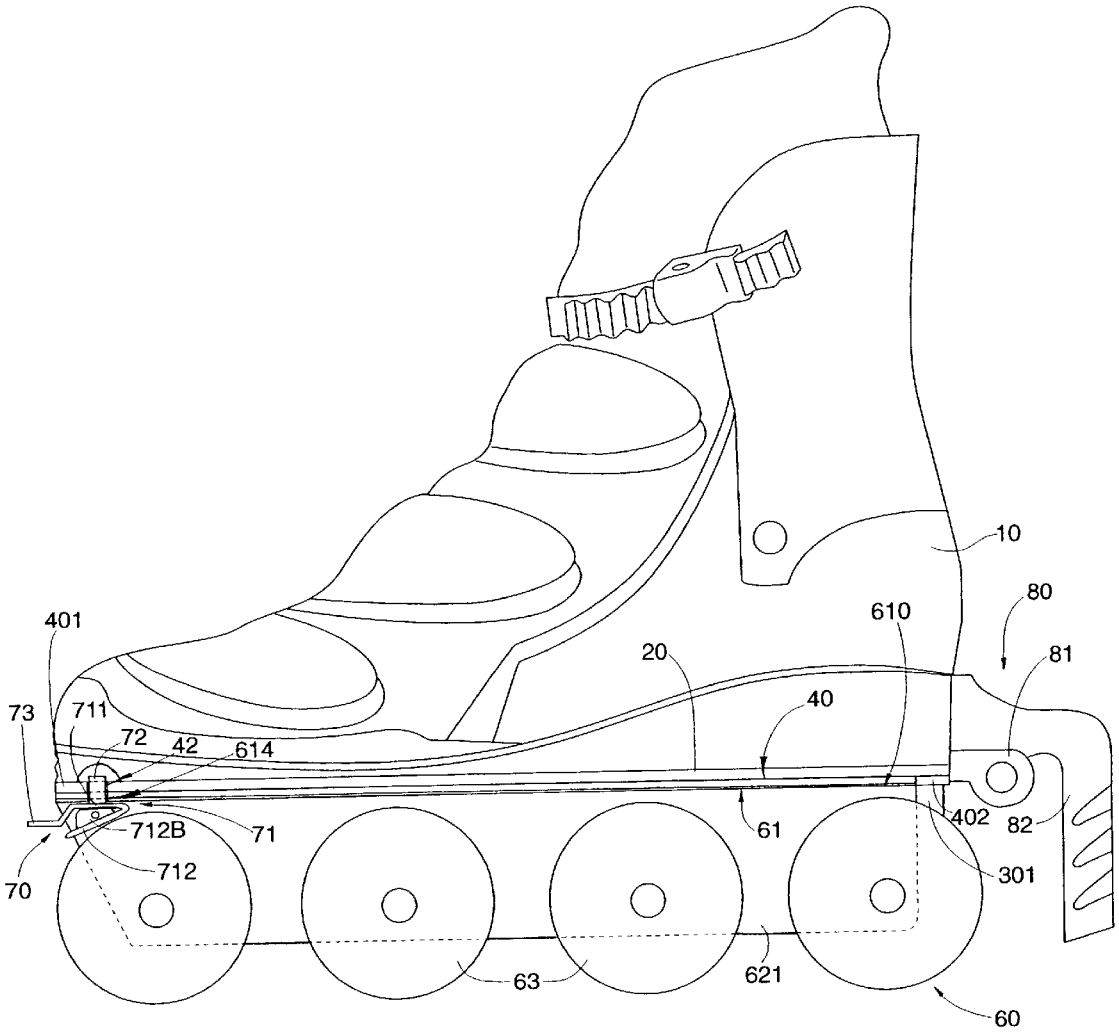
FIG. 4 is a partially sectional side view of the inline skate with detachable roller device according to the above first preferred embodiment of the present invention, illustrating a locking means provided between a roller sole and a roller device.

As shown in FIG. 3, both the receiving groove 40 and the side receiving groove 50 are T-shape grooves respectively. The receiving groove 40 is centrally and longitudinally extended along the bottom surface 21 of the roller sole 20, wherein the receiving groove 40 has a receiving front end 401 positioned at a front end of the roller sole 20 and a rear stopper 402 positioned at a rear end of the roller sole 20 (as shown in FIG. 4).

The roller device 60 comprises a holding blade member 61 and four roller wheels 63 rotatably mounted along the holding blade member 61 in a straight line manner, wherein the holding blade member 61 comprises a T-shape top connecting rail 610 longitudinally extended along the holding blade member 61 for fittedly engaging with the receiving groove 40 by sliding the top connecting rail 610 into the receiving groove 40 through the receiving front end 401 thereof.

Figure 5:
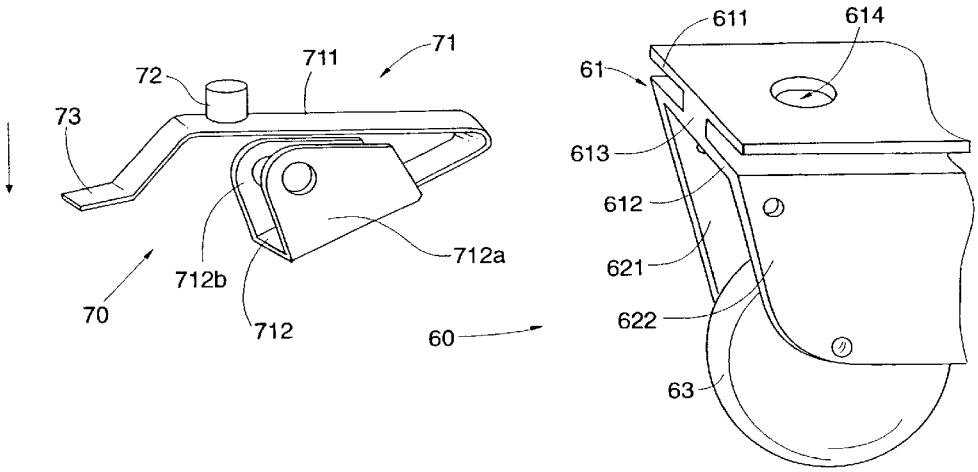
FIG. 5 is a perspective view of a front portion of the roller device of the inline skate with detachable roller device for illustrating the locking means according to the above first preferred embodiment of the present invention.

Referring to FIGS. 3 and 5 of the drawings, the holding blade member 61 of the roller device 60 according to the present invention integrally comprises an elongated rail portion 611, an elongated base portion 612 parallelly disposed under the rail portion 611, and a narrower vertical joint piece portion 613 centrally and integrally connected between the rail portion 611 and the base portion 612, wherein the rail portion 611 and the joint piece portion 613 constitute the T-shape top connecting rail 610 disclosed above. The holding blade member 61 further comprises two roller shields 621, 622 respectively extended downwardly from two outer side edges of the base portion 612. The four roller wheels 63 are rotatably mounted between the two roller shields 621, 622. As shown in FIGS. 3 and 5, a through hole 614 is vertically formed at a front end portion of the holding blade member 61 that penetrates through the base portion 612, the vertical joint piece portion 613 and the rail portion 611.

Referring to FIG. 3, as mentioned above, the receiving groove 40 and the side receiving groove 50 are two identical T-shape groove respectively adapted for the T-shape top connecting rail 61, including the rail portion 611 and the vertical joint piece portion 613, to fittedly engage therein. Accordingly, the walkable inline skate of the present invention has two different modes, namely the inline skating mode (as shown in FIG. 1) and the walking mode (as shown in FIG. 2).

The locking means 70 is provided between the roller sole 20 and the holding blade member 61 for firmly locking the roller device 60 to affix within the receiving groove 40. As shown in FIG. 5 of the drawing, according to the first preferred embodiment, the locking means 70 comprises a resilient V-shape locking body 71 having an upper piece 711 and a lower piece 712. The locking means 70 further comprises a locking stub 72 upwardly protruded from the upper piece 711 of the V-shape locking body 71 and a lock release handle 73 integrally connected to a front end of the first piece 711 of the V-shape locking body 71. The lower piece 712 further comprises two connection wings 712*a*, 712*b* upwardly extended from two side edges of the lower piece 712.

As shown in FIGS. 4 and 5, the locking means 70 is installed to the front end of the roller device 60 by positioning the locking body 71 between the two roller shields 621, 622 and firmly affixing the two connection wings 712*a*, 712*b* of the lower piece 712 of the V-shape locking body 71 by screwing or welding to the two roller shields 621, 622 of the holding blade member 61 respectively, wherein the lock release handle 73 is frontwardly extended out of the front end of the holding blade member 61 and the upper piece 711 is positioned below and pressing against the base portion 612 with the locking stub 72 upwardly penetrating through the through hole 614.

The roller sole 20 further provides a locking hole 23 at the receiving front end 401 of the receiving groove 40, as shown in FIG. 4. Also, as shown in FIG. 3, an inner surface of the rigid side wall 22 has a side locking hole 221 formed at a receiving front end of the side receiving groove 50. The positioning of the locking hole 23 on the front receiving end of the receiving groove 40 must be coaxially aligned with the locking stub 72 of the locking means 70 installed on the roller device 60 when the T-shape top connecting rail 610 is entirely inserted into the receiving groove 40. Similarly, the position of the side locking hole 221 formed at the front receiving end of the side receiving groove 50 must also be coaxially aligned with the locking stub 72 of the locking means 70 when the T-shape top connecting rail 610 is entirely inserted into the side receiving groove 50. Therefore, when the T-shape top connecting rail 610 of the roller device 60 is inserted into the receiving groove 40 or the side receiving groove 50, the locking stub 72 would be engaged into the respective locking hole 42 on the receiving groove 40 or the side locking hole 221 on the side receiving groove 50, so as to effectively limit the movement of a horizontal movement of the roller device 60.

Figure 10:
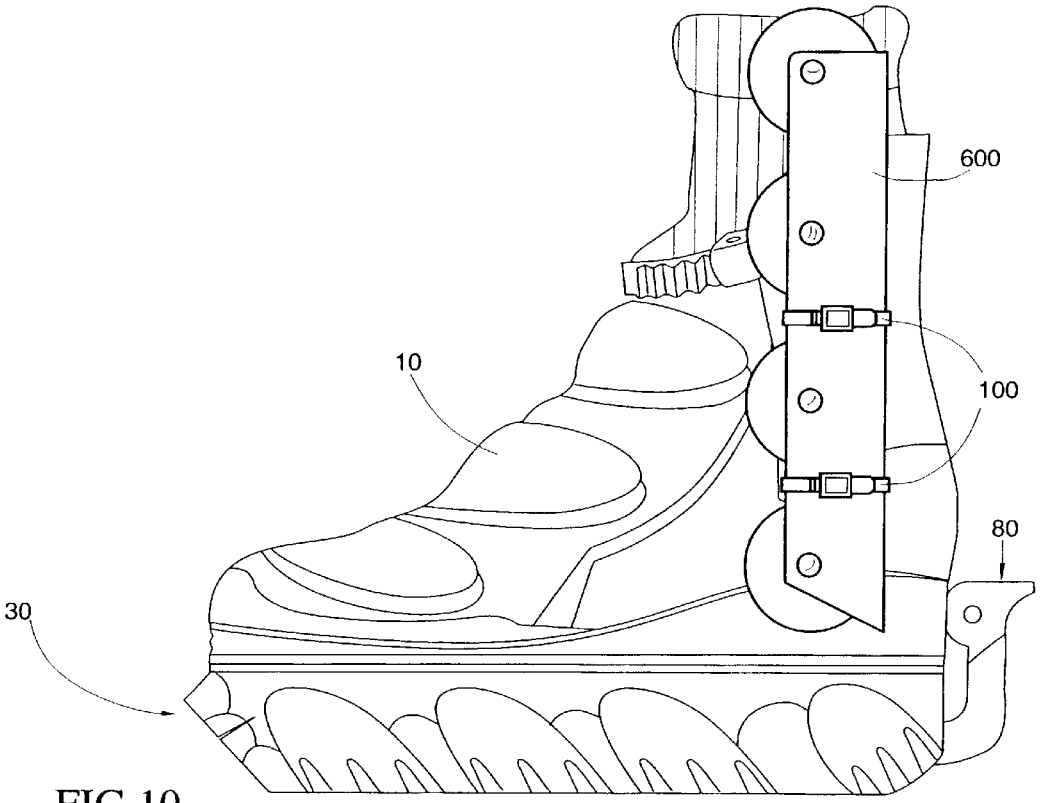
FIG. 10 is a side view of the inline skate with detachable roller device during the walking mode according to the present invention.

As shown in FIG. 4, the brake device 80 comprises a hinge 81 connected to the rear end of the footwear 10, and a rubber brake 82 connected to the hinge 81, wherein the hinge 81 is loaded with a predetermined strength that requires a predetermined amount of torque to move the brake device 80 from an open position to a close position, and vice versa. As shown in FIGS. 2 and 10, when the walkable inline skate of the present invention is in the walking mode, the user can apply the force to bend down the brake device 80 with the rubber brake 82 inserted in a space between the two supporters 301, 302, as shown in FIG. 2, so that the user can walk with the flat base 32 of the walkable sole 30.

When the user wants to set the walkable inline skate to the inline skating mode, the user can firmly connect the roller device 60 with the roller sole 20 between two supporters 301, 302 by sliding the top connecting rail 610 of the holding blade member 61 into the receiving groove 40 of the roller sole 20. When the top connecting rail 610 is entirely inserted into the receiving groove 40, the locking stub 72 of the locking means 70 would plug into the locking hole 42 on the receiving groove 40 for firmly locking the roller device 60 in position and limiting the horizontal movement of the rollers arrangement 60, as shown in FIG. 4. During the inline skating mode, the four roller wheels 63 would be extended through the passing gap 35 to contact with road surface, as shown in FIG. 1.

When the user desires to change the walkable inline skate to the walking mode from the inline skating mode to avoid a difficult inline skating road condition, the user merely needs to press down the lock release handle 73 of the locking means 70 until the locking stub 72 is disengaged with the locking hole 42 so as to release the locking condition. At that moment, the top connecting rail 610 can thus be withdrawn from the receiving groove 40 so as to detach and disconnect the roller device 60 from the roller sole 20, so that the user can walk with the flat bases 32 of the two supporters 301, 302 of the walkable sole 30.

During the walking mode, the roller device 60 which is detached from the receiving groove 40 can be received within the receiving chamber 34 defined between the two supporters 301, 302. Moreover, the top connecting rail 610 of the roller device 60 can also be entirely inserted into the side receiving groove 50 until the locking stub 72 of the locking means 70 is plugged into the side locking hole 221 so as to firmly engage the roller device 60 with the supporter 301 to prevent unwanted movement of the roller device 60 during walking.

In view of the above disclosed embodiment, the walkable inline skate of the present invention not only allows the user to skate and walk selectively with the same footwear in accordance with the road surface condition, but also enables the user to easily switch the walkable inline skate from a walking mode to a inline skating mode, and vice versa without using any special tool. Moreover, the walkable inline skate of the present invention also provides a strong and durable connection between a roller sole 20 of the footwear 10 and the set of roller device 60.

Figure 7:
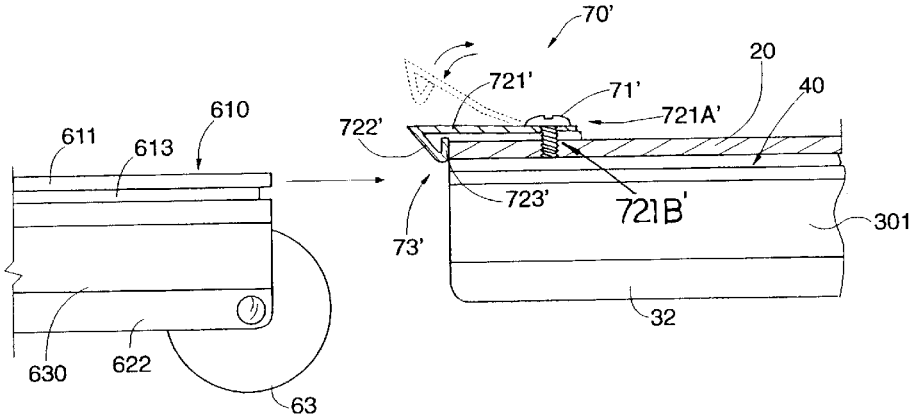
FIG. 7 is a partial sectional view, illustrating the relationship between the locking means and the roller device, according to the above second preferred embodiment of the present invention.
Figure 6:
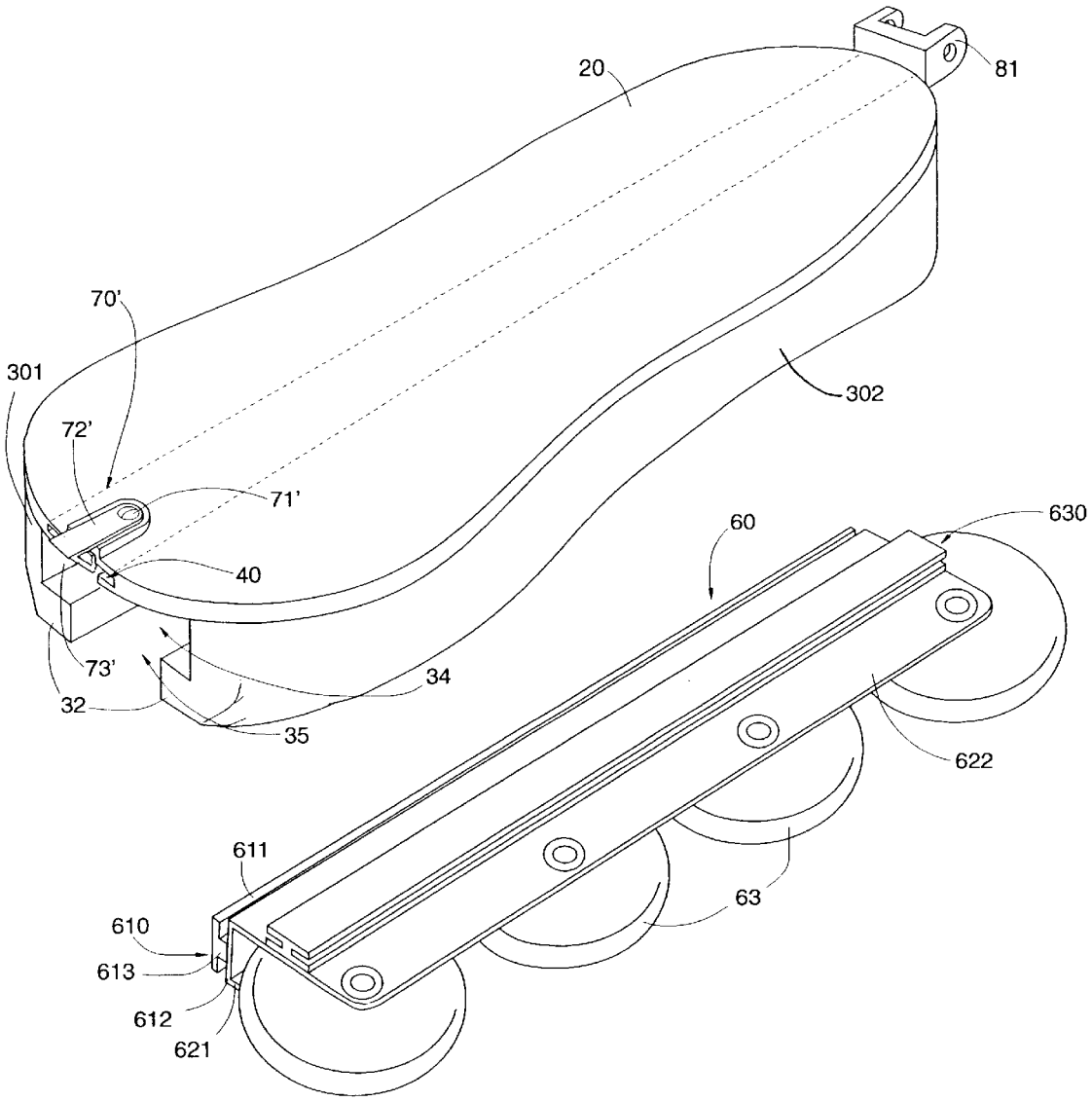
FIG. 6 is a perspective view of the roller sole and the roller device of the inline skate with detachable roller device according to a second preferred embodiment of the present invention, where the roller device is fastened in a receiving groove by an alternative locking means.

Referring to FIGS. 6 and 7 of the drawings, a second preferred embodiment of the present invention is disclosed, wherein an alternative mode of the locking means 70' is illustrated. Basically, the second preferred embodiment is differed from the first preferred embodiment in the design of the locking means 70' and by providing an additional set of side connecting rail 630 on the roller device 60. The locking means 70' comprises a screw 71' and an resilient lock plate 72', wherein the resilient lock plate 72' comprises a fastening section 721' having a through hole 721A' at a rear end thereof, a connecting section 722' downwardly and inclinedly extended from a front end of the fastening section 721', and a contacting section 723' upwardly and integrally extended from a free end of the connecting section 722' to form a triangular stopper head 73'.

On a predetermined position of the roller sole 20 has provided a fastening hole 721B' in align with the through hole 721A' of the fastening section 721' of the resilient lock plate 72' for the screw 71' to screw through the through hole 721A' and engage with the fastening hole 721B' so as to firmly fasten the resilient lock plate 72' on the roller sole 20, wherein the stopper head 73' must be positioned at the receiving front end 401 of the receiving groove 40 in order to block the receiving groove 40.

Besides, the additional side connecting rail 630, which has an identical structure as the top connecting rail 610, is integrally affixed along one of the roller shields 622. The side connecting rail 630 also comprises an elongated rail portion 631, an elongated base portion 632 and a narrower joint piece portion 633 integrally connected between the rail portion 631 and the base portion 632.

The fastening section 721' of the resilient lock plate 72' is made of material that has elastic characteristic and provides a spring board effect. When an external force is applied on the fastening section 721' to lift it upward, the receiving front end 401 of the receiving groove 40 is clear from blocking, as shown in FIG. 7, for the T-shape top connecting rail 610 of the roller device 60 to slide in or out. When the external up-lifting force is released, the fastening section 721' would automatically snap back to its original position, where the contacting section 723' would be pressed against the front end of the T-shape top connecting rail 610 of the roller device 60 so as to effectively limit the horizontal movement of the roller device 60 during the inline skating mode.

During the walking mode, the user may simply slide out the T-shape top connecting rail 610 from the receiving groove 40 and re-insert the side connecting rail 630 of the holding blade member 61 of the roller device 60 into the receiving groove 40 so as to transversely store the roller device 60 inside the receiving chamber 34 between the two supporters 301, 302. Due to the presence of the side connecting rail 630, the rigid side wall 22 of the first preferred embodiment, which is downwardly and perpendicularly from the bottom surface 21 of the roller sole 20 as illustrated in FIGS. 1 to 3, can thus be omitted. The roller device 60 can be locked in position inside the receiving chamber 34 simply by engaging the side connecting rail 630 with the receiving groove 40 when it is not used during the walking mode.

In fact, a length of the top connecting rail 610 and the side connecting rail 630 the roller device 60 are preferably just equal to a length of the receiving grooves 40, so that when the contacting section 723' of the locking means 70' can be just pressed against the front end of the rail portion 611 of the top connecting rail 610 or the rail portion 631 of the side connecting rail 630 of the roller device 60 in order to lock the roller device 60 in position.

Figure 8:
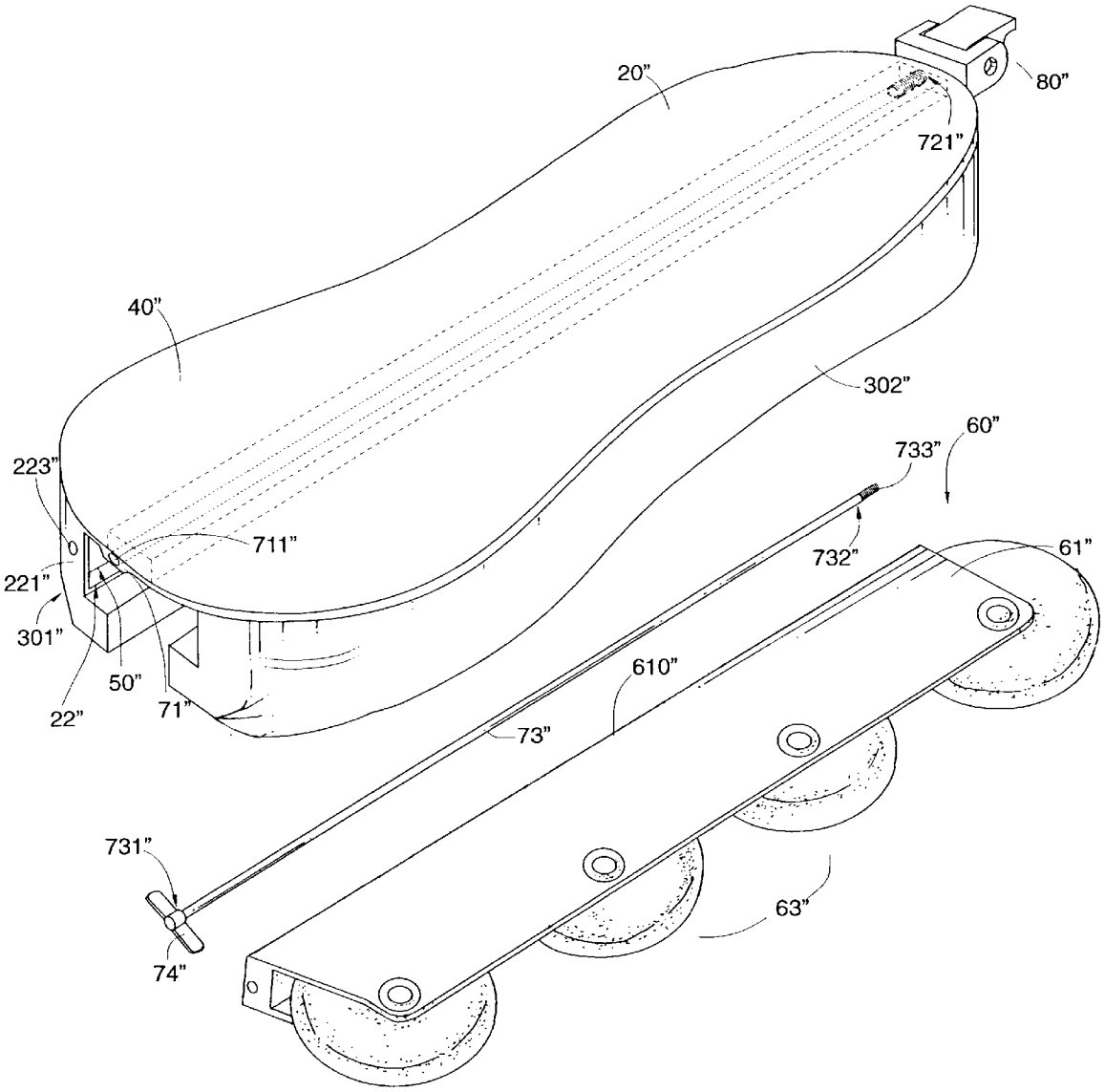
FIG. 8 is an exploded perspective view of the roller sole and the roller device of the inline skate with detachable roller device according to a third preferred embodiment of the present invention, in which the footwear is not shown.
Figure 9:
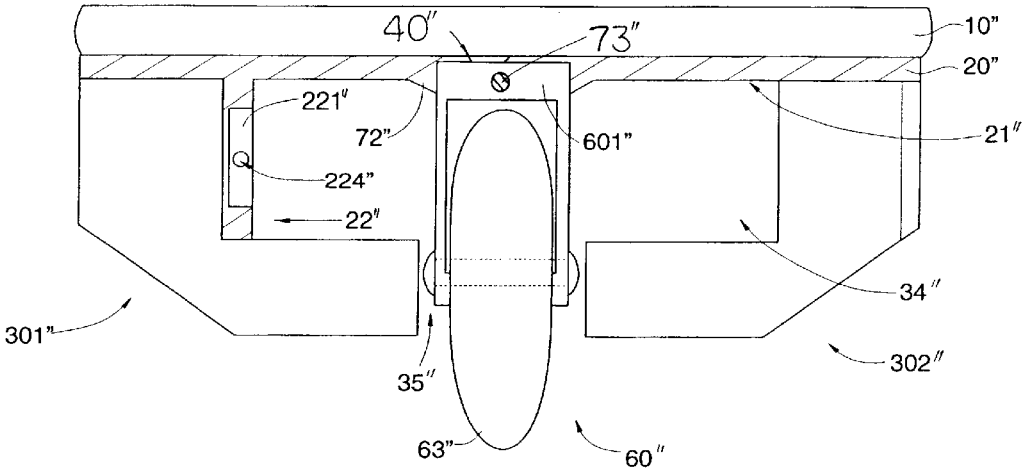
FIG. 9 is a partial front sectional view of the inline skate with detachable roller device according to the above third preferred embodiment of the present invention, in which the footwear is not shown.

Referring to FIGS. 8 to 9 of the drawings, a third preferred embodiment of the present invention is illustrated. The walkable inline skate according to the third preferred embodiment of the present invention also comprises a footwear 10" (as shown in FIG. 10), a roller sole 20" integrally connected with a bottom portion of the footwear 10", a pair of supporters 301", 302" integrally extended from a bottom surface 21" of the roller sole 20", a set of roller device 60", a locking means 70" for ensuring the roller device 60" are connected to the roller sole 20", and a brake device 80".

As shown in FIG. 8 of the drawing, the locking means 70" of the third preferred embodiment comprises a front supporter 71", a rear supporter 72" and a fastening rod 73". The front supporter 71" which has an axial hole 711" is integrally and downwardly extended from a front end of the roller sole 20". The rear supporter 72" which has an axial screw hole 721" is integrally and downwardly extended from a rear end of the roller sole 20". The roller sole 20" has a rectangular receiving groove 40" provided at its bottom surface and positioned between the front supporter 71" and the rear supporter 72". Furthermore, a rigid side wall 22" is integrally and perpendicularly extended downwardly from the bottom surface 21" of the roller sole 20". The rigid side wall 22" has a rectangular side receiving groove 50" provided at an inner surface thereof and forms a front end wall 221" (as shown in FIG. 8) and a rear end wall 222" (as shown in FIG. 9) at the front end and rear end of the side receiving groove 50" respectively, wherein a rod hole 223" is forms at the front end wall 221" and a threaded hole 224" is formed at the rear end wall 222".

The fastening rod 73" has a diameter equal to a diameter of the axial hole 711", a front end 731" connected with a turning wing 74" which is adapted for the user to easily turn the fastening rod 73", and a rear end 732" providing a threaded portion 733" adapted for screwing into the axial screw hole 721" of the rear supporter 72" or the threaded hole 224" of the rear end wall 222" of the side wall 22".

Referring to FIG. 9, the roller device 60" according to the third preferred embodiment also comprises a holding blade member 61". The holding blade member 61" has a rectangular top connecting rail 610" which has an axial passage 611" extended along the length of the top connecting rail 610", two roller shields 621", 622" rotatably mounted tour roller wheels 63" therebetween in a straight line manner. The length of the roller device 60" must be slightly less than the distance between the front supporter 71" and the rear supporter 72". The size of the rectangular top connecting rail 610" is preferably equal to the size of the rectangular receiving groove 40" and rectangular side receiving groove 50".

Accordingly, during the inline skating mode, the user can firmly connect the roller device 60" with the roller sole 20" by fittedly engaging the top connecting rail 610" of the roller device 60" into the receiving groove 40' provided on the roller sole 20" of the walkable inline skate. Then, the fastening rod 73" is penetrated through the axial hole 711" of the front supporter 71" and the axial passage 611" of the holding blade member 61" of the roller device 60" until the threaded portion 733" of the fastening rod 73" is screwed to the axial screw hole 721" of the rear supporter 72" so as to firmly lock the roller device 60" in skating position (as shown in FIG. 9).

During the walking mode, the user may detach the roller device 60" from the roller sole 20" by unscrewing the fastening rod 73". Moreover, the detached roller device 60" can be transversely mounted to the side wall 22" by engaging the top connecting rail 61" into the side receiving groove 50" of the side wall 22" and fastening the roller device 60" horizontally by penetrating the fastening rod 73" through the rod hole 223" of the front end wall 221" and the axial passage 611" of the holding blade member 61" of the roller device 60" until the threaded portion 733" of the fastening rod 73" is screwed to the threaded hole 224" of the rear end wall 222" so as to firmly lock the roller device 60" in storing position inside the receiving chamber 34" between the two supporters 310", 302".

Referring to FIG. 10 of the drawing, on the side of the footwear 10 further provides a roller device holder means 100 for binding the roller device 60" to an outer side of the footwear 10, so that the user can bring a spare roller device **60*a* or store the roller device 60" by holding with the holder means 100** during walking mode.

What is claimed is:

1. A walkable inline skate, comprising a footwear, a roller sole integrally connected with a bottom portion of said footwear, a pair of supporters integrally extended from two sides of a bottom surface of said roller sole respectively to form a walkable sole for walking purpose, wherein a receiving chamber is defined between said two supporters and longitudinally extended along said bottom surface of said roller sole, said roller sole having a receiving groove centrally and longitudinally extended along said bottom surface of said roller sole;

a roller device comprising a holding blade member and four roller wheels rotatably mounted along said holding blade member in a straight line manner, wherein said holding blade member has a top connecting rail longitudinally extended along the holding blade member for fittedly engaging with said receiving groove of said roller sole so as to connect with said roller sole;

a locking means which is provided between said roller sole and said holding blade member for firmly locking said top connecting rail of said roller device to engage within said receiving groove of said roller sole, wherein said roller device is capable of detaching from said roller sole when said locking means is released, and that said detached roller device is able to be received and stored inside said receiving chamber defined between said two supporters; and a brake device connected to a rear end of said footwear;

wherein said receiving groove is a T-shape groove and has a receiving front end positioned at a front end of said roller sole and a rear stopper positioned at a rear end of said roller sole, and that said top connecting rail is a T-shape rail longitudinally extended along said holding blade member for fittedly engaging with said receiving groove by sliding said T-shape top connecting rail into said T-shape receiving groove through said receiving front end thereof;

wherein said holding blade member of said roller device integrally comprises an elongated rail portion, an elongated base portion parallelly disposed under said rail portion, and a vertical joint piece portion centrally and integrally connected between said rail portion and said base portion, said vertical joint piece portion having a width narrower than that of said rail portion, wherein said rail portion and said joint piece portion constitute said T-shape top connecting rail, said holding blade member further comprising two roller shields respectively extended downwardly from two outer side edges of said base portion, said four roller wheels being rotatably mounted between said two roller shields;

wherein a through hole is vertically formed at a front end portion of said holding blade member that penetrates through said base portion, said vertical joint piece portion and said rail portion, moreover, said roller sole further provides a locking hole positioned at said receiving front end of said receiving groove, said locking means comprising a resilient V-shape locking body having an upper piece and a lower piece, a locking stub upwardly protruded from said upper piece of said V-shape locking body, and a lock release handle integrally connected to a front end of said first piece of said V-shape locking body, said locking means being installed to said front end of said roller device by positioning said locking body between said two roller shields and firmly affixing said lower piece to said two roller shields of said holding blade member, wherein said lock release handle is frontwardly extended out of said front end of said holding blade member and said upper piece is positioned below and pressed against said base portion with said locking stub upwardly penetrating through said through hole, therefore, said positioning of said locking hole on said front receiving end of said receiving groove is coaxially aligned with said locking stub of said locking means installed on said roller device when said T-shape top connecting rail is entirely inserted into said receiving groove, and that when said t-shape top connecting rail of said roller device is inserted into said receiving groove, said locking stub is engaged into said locking hole on said receiving groove to effectively limit said roller device's movement.

2. A walkable inline skate, as recited in claim 1, wherein said lower piece further comprises two connection wings upwardly extended from two side edges of said lower piece of said V-shape locking body, wherein said two connection wings is affixed to said two roller shields of said holding blade member respectively.

3. A walkable inline skate, as recited in claim 1, wherein said roller sole further comprises a rigid side wall which is integrally extended downwardly and perpendicularly from said bottom surface of said roller sole and is attached to an inner wall of one of said supporters, an inner surface of said side wall having a side receiving groove positioned and extended along a length of said side wall, said roller device is capable of transversely mounting on said side wall by engaging said top connecting rail into said side receiving groove when said roller device is not used.

4. A walkable inline skate, as recited in claim 3, wherein said side receiving groove is a T-shape groove respectively adapted for receiving said T-shape top connecting rail, including said rail portion and said vertical joint piece portion, to fittedly engage therein.

5. A walkable inline skate, as recited in claim 4, wherein a side locking hole is provided on said side wall and positioned at a front receiving end of said side receiving groove, wherein when said T-shape top connecting rail is entirely inserted into said side receiving groove and transversely received in said receiving chamber, said locking stub of said locking means is coaxially aligned with and inserted into said side locking hole on said side receiving groove.

6. A walkable inline skate, as recited in claim 5, wherein said pair of supporters of said walkable sole are in L-shaped and made of rubber material, each of said two supporters has a vertical support and a flat base for walking purpose, wherein said receiving chamber is formed between said two vertical supports and a passing gap is formed between said two flat bases, said receiving chamber having a size larger than that of said roller device, so that when said roller device is detached from said roller sole, said roller device is able to be transversely stored in said receiving chamber and mounted on said side wall.

7. A walkable inline skate, as recited in claim 6, wherein said brake device comprises a hinge connected to said rear end of said footwear and a rubber brake connected to said hinge, wherein said hinge is loaded with a predetermined strength that requires a predetermined amount of torque to move said brake device from an open position to a close position, and vice versa, therefore said brake device is able to bend down with said rubber brake inserting in a space between said two supporters.

8. A walkable inline skate, comprising a footwear, a roller sole integrally connected with a bottom portion of said footwear, a pair of supporters integrally extended from two sides of a bottom surface of said roller sole respectively to form a walkable sole for walking purpose, wherein a receiving chamber is defined between said two supporters and longitudinally extended along said bottom surface of said roller sole, said roller sole having a receiving groove centrally and longitudinally extended along said bottom surface of said roller sole;

a roller device comprising a holding blade member and four roller wheels rotatably mounted along said holding blade member in a straight line manner, wherein said holding blade member has a top connecting rail longitudinally extended along the holding blade member for fittedly engaging with said receiving groove of said roller sole so as to connect with said roller sole;

a locking means which is provided between said roller sole and said holding blade member for firmly locking said top connecting rail of said roller device to engage within said receiving groove of said roller sole, wherein said roller device is capable of detaching from said roller sole when said locking means is released, and that said detached roller device is able to be received and stored inside said receiving chamber defined between said two supporters; and a brake device connected to a rear end of said footwear;

wherein said roller sole further comprises a rigid side wall which is integrally extended downwardly and perpendicularly from said bottom surface of said roller sole and is attached to an inner wall of one of said supporters, an inner surface of said side wall having a side receiving groove positioned and extended along a length of said side wall, said roller device is capable of transversely mounting on said side wall by engaging said top connecting rail into said side receiving groove when said roller device is not used.

9. A walkable inline skate, as recited in claim 8, wherein said pair of supporters of said walkable sole are in L-shaped and made of rubber material, each of said two supporters has a vertical support and a flat base for walking purpose, wherein said receiving chamber is formed between said two vertical supports and a passing gap is formed between said two flat bases, said receiving chamber having a size larger than that of said roller device, so that when said roller device is detached from said roller sole, said roller blade is able to be transversely stored in said receiving chamber.

10. A walkable inline skate, comprising a footwear, a roller sole integrally connected with a bottom portion of said footwear, a pair of supporters integrally extended from two sides of a bottom surface of said roller sole respectively to form a walkable sole for walking purpose, wherein a receiving chamber is defined between said two supporters and longitudinally extended along said bottom surface of said roller sole, said roller sole having a receiving groove centrally and longitudinally extended along said bottom surface of said roller sole;

a roller device comprising a holding blade member and four roller wheels rotatably mounted along said holding blade member in a straight line manner, wherein said holding blade member has a top connecting rail longitudinally extended along the holding blade member for fittedly engaging with said receiving groove of said roller sole so as to connect with said roller sole;

a locking means which is provided between said roller sole and said holding blade member for firmly locking said top connecting rail of said roller device to engage within said receiving groove of said roller sole, wherein said roller device is capable of detaching from said roller sole when said locking means is released, and that said detached roller device is able to be received and stored inside said receiving chamber defined between said two supporters; and a brake device connected to a rear end of said footwear;

wherein said receiving groove is a T-shape groove and has a receiving front end positioned at a front end of said roller sole and a rear stopper positioned at a rear end of said roller sole, and that said top connecting rail is a T-shape rail longitudinally extended along said holding blade member for fittedly engaging with said receiving groove by sliding said T-shape top connecting rail into said T-shape receiving groove through said receiving front end thereof;

wherein said holding blade member of said roller device integrally comprises an elongated rail portion, an elongated base portion parallelly disposed under said rail portion, and a vertical joint piece portion centrally and integrally connected between said rail portion and said base portion, said vertical joint piece portion having a width narrower than that of said rail portion, wherein said rail portion and said joint piece portion constitute said T-shape top connecting rail, said holding blade member further comprising two roller shields respectively extended downwardly from two outer side edges of said base portion, said four roller wheels being rotatably mounted between said two roller shields;

wherein said roller device further comprises a T-shape side connecting rail which has an identical structure as said top connecting rail and is integrally affixed along one of said roller shields, said side connecting rail also comprising an elongated rail portion, an elongated base portion and a joint piece portion integrally connected between said rail portion and said base portion, so that said roller device is capable of transversely receiving inside said receiving chamber and connected with said roller sole by inserting said side connecting rail into said receiving groove.

11. A walkable inline skate, as recited in claim 10, wherein said locking means comprises an resilient lock plate which comprises a fastening section having a rear end connected to a front end of said roller sole, a connecting section downwardly and inclinedly extended from a front end of said fastening section, and a contacting section upwardly and integrally extended from a free end of said connecting section to form a triangular stopper, so that said resilient lock plate is firmly fastened on said front end of said roller sole and said stopper head is positioned at said receiving front end of said receiving groove in order to block said receiving groove, said fastening section of said resilient lock plate being made of material that has elastic characteristic and provides a spring board effect, therefore when an external force is applied on said fastening section to lift it upward, said receiving front end of said receiving groove is clear from blocking for said T-shape top connecting rail and said side connecting rail of said roller device to slide in or out, however when said external up-lifting force is released, said fastening section would automatically snap back to block said receiving front end of said receiving groove, wherein a length of said top connecting rail and said side connecting rail of said roller device are equal to a length of said receiving grooves, so that when said contacting section of said locking means is able to press against said front end of said rail portion of said top connecting rail or said rail portion of said side connecting rail of said roller device in order to lock said roller device in position.

12. A walkable inline skate, as recited in claim 11, wherein said pair of supporters of said walkable sole are in L-shaped and made of rubber material, each of said two supporters has a vertical support and a flat base for walking purpose, wherein said receiving chamber is formed between said two vertical supports and a passing gap is formed between said two flat bases, said receiving chamber having a size larger than that of said roller device, so that when said roller device is detached from said roller sole, said roller blade is able to be transversely stored in said receiving chamber.

13. A walkable inline skate, comprising a footwear, a roller sole integrally connected with a bottom portion of said footwear, a pair of supporters integrally extended from two sides of a bottom surface of said roller sole respectively to form a walkable sole for walking purpose, wherein a receiving chamber is defined between said two supporters and longitudinally extended along said bottom surface of said roller sole, said roller sole having a receiving groove centrally and longitudinally extended along said bottom surface of said roller sole;

a roller device comprising a holding blade member and four roller wheels rotatably mounted along said holding blade member in a straight line manner, wherein said holding blade member has a top connecting rail longitudinally extended along the holding blade member for fittedly engaging with said receiving groove of said roller sole so as to connect with said roller sole;

a locking means which is provided between said roller sole and said holding blade member for firmly locking said top connecting rail of said roller device to engage within said receiving groove of said roller sole, wherein said roller device is capable of detaching from said roller sole when said locking means is released, and that said detached roller device is able to be received and stored inside said receiving chamber defined between said two supporters; and a brake device connected to a rear end of said footwear;

wherein said receiving groove is a T-shape groove and has a receiving front end positioned at a front end of said roller sole and a rear stopper positioned at a rear end of said roller sole, and that said top connecting rail is a T-shape rail longitudinally extended along said holding blade member for fittedly engaging with said receiving groove by sliding said T-shape top connecting rail into said T-shape receiving groove through said receiving front end thereof;

wherein said holding blade member of said roller device integrally comprises an elongated rail portion, an elongated base portion parallelly disposed under said rail portion, and a vertical joint piece portion centrally and integrally connected between said rail portion and said base portion, said vertical joint piece portion having a width narrower than that of said rail portion, wherein said rail portion and said joint piece portion constitute said T-shape top connecting rail, said holding blade member further comprising two roller shields respectively extended downwardly from two outer side edges of said base portion, said four roller wheels being rotatably mounted between said two roller shields;

wherein said locking means comprises an resilient lock plate which comprises a fastening section having a rear end connected to a front end of said roller sole, a connecting section downwardly and inclinedly extended from a front end of said fastening section, and a contacting section upwardly and integrally extended from a free end of said connecting section to form a triangular stopper, so that said resilient lock plate is firmly fastened on said front end of said roller sole and said stopper head is positioned at said receiving front end of said receiving groove in order to block said receiving groove, said fastening section of said resilient lock plate being made of material that has elastic characteristic and provides a spring board effect, therefore when an external force is applied on said fastening section to lift it upward, said receiving front end of said receiving groove is clear from blocking for said T-shape top connecting rail of said roller device to slide in or out, however when said external up-lifting force is released, said fastening section would automatically snap back to block said receiving front end of said receiving groove, wherein a length of said top connecting rail of said roller device is equal to a length of said receiving grooves, so that when said contacting section of said locking means is able to press against said front end of said rail portion of said top connecting rail of said roller device in order to lock said roller device in position.

14. A walkable inline skate, as recited in claim 13, wherein said pair of supporters of said walkable sole are in L-shaped and made of rubber material, each of said two supporters has a vertical support and a flat base for walking purpose, wherein said receiving chamber is formed between said two vertical supports and a passing gap is formed between said two flat bases, said receiving chamber having a size larger than that of said roller device, so that when said roller device is detached from said roller sole, said roller blade is able to be transversely stored in said receiving chamber.

15. A walkable inline skate, comprising a footwear, a roller sole integrally connected with a bottom portion of said footwear, a pair of supporters integrally extended from two sides of a bottom surface of said roller sole respectively to form a walkable sole for walking purpose, wherein a receiving chamber is defined between said two supporters and longitudinally extended along said bottom surface of said roller sole, said roller sole having a receiving groove centrally and longitudinally extended along said bottom surface of said roller sole;

a roller device comprising a holding blade member and four roller wheels rotatably mounted along said holding blade member in a straight line manner, wherein said holding blade member has a top connecting rail longitudinally extended along the holding blade member for fittedly engaging with said receiving groove of said roller sole so as to connect with said roller sole;

a locking means which is provided between said roller sole and said holding blade member for firmly locking said top connecting rail of said roller device to engage within said receiving groove of said roller sole, wherein said roller device is capable of detaching from said roller sole when said locking means is released, and that said detached roller device is able to be received and stored inside said receiving chamber defined between said two supporters; and a brake device connected to a rear end of said footwear;

wherein said locking means comprises a front supporter, a rear supporter and a fastening rod, said front supporter having an axial hole is integrally and downwardly extended from a front end of said roller sole, said rear supporter which has an axial screw hole being integrally and downwardly extended from a rear end of said roller sole, said receiving groove being in rectangular shaped and positioned between said front supporter and said rear supporter, wherein said fastening rod has a diameter equal to a diameter of said axial hole, a front end connected with a turning wing for turning said fastening rod, and a rear end providing a threaded portion adapted for screwing into said axial screw hole of said rear supporter, wherein said top connecting rail of said holding blade member of said roller device is in rectangular shaped, said top connecting rail further having an axial passage extended along a length of said top connecting rail which is slightly less than a distance between said front supporter and said rear supporter, and that a size of said rectangular top connecting rail is equal to a size of said rectangular receiving groove, whereby said roller device is able to be firmly connected with said roller sole by fittedly engaging said rectangular top connecting rail of said roller device into said rectangular receiving groove provided on said roller sole, moreover said fastening rod is penetrated through said axial hole of said front supporter and said axial passage of said holding blade member of said roller device until said threaded portion of said fastening rod is screwed to said axial screw hole of said rear supporter so as to firmly lock said roller device in position;

wherein a rigid side wall is integrally and perpendicularly extended downwardly from said bottom surface of said roller sole, said rigid side wall having a rectangular side receiving groove provided at an inner surface thereof and forming a front end wall and a rear end wall at a front end and a rear end of said side receiving groove respectively, wherein a rod hole is forms at said front end wall and a threaded hole is formed at said rear end wall of said side wall, so that when said roller device is detached from said roller sole by unscrewing said fastening rod, said detached roller device is able to be transversely mounted to said side wall by engaging said top connecting rail into said side receiving groove of said side wall and fastening said roller device transversely by penetrating said fastening rod through said rod hole of said front end wall and said axial passage of said holding blade member of said roller device until said threaded portion of said fastening rod is screwed to said threaded hole of said rear end wall so as to firmly lock said roller device in position inside said receiving chamber defined between said two supporters.

16. A walkable inline skate, as recited in claim 15, wherein said pair of supporters of said walkable sole are in L-shaped and made of rubber material, each of said two supporters has a vertical support and a flat base for walking purpose, wherein said receiving chamber is formed between said two vertical supports and a passing gap is formed between said two flat bases, said receiving chamber having a size larger than that of said roller device, so that when said roller device is detached from said roller sole, said roller blade is able to be transversely stored in said receiving chamber.

* * * * *